US005868240A

United States Patent [19]

Knoepfel et al.

[11] Patent Number: 5,868,240

[45] Date of Patent: Feb. 9, 1999

[54] SPRING CONVEYOR APPARATUS

[75] Inventors: Hans Knoepfel, Roggwil; Siefgried Grueninger, St. Gallen, both of Switzerland

[73] Assignee: Spuehl A.G., St. Gallen, Switzerland

[21] Appl. No.: 751,066

[22] Filed: Nov. 15, 1996

[30] Foreign Application Priority Data

Nov. 17, 1995 [DE] Germany ..... 195 42 846.3

[51] Int. Cl.[6] ..... B65G 15/14

[52] U.S. Cl. ..... 198/626.1; 198/405

[58] Field of Search ..... 198/405, 417, 198/604, 606, 626.1, 817

[56] References Cited

U.S. PATENT DOCUMENTS

| | | | |
|---|---|---|---|
| 4,406,359 | 9/1983 | Cole et al. | 198/626.1 |
| 4,750,728 | 6/1988 | Keller | 198/626.1 X |
| 4,756,400 | 7/1988 | Funo et al. | 198/626.1 X |
| 4,860,880 | 8/1989 | Hinchcliffe et al. | 198/405 |
| 4,863,010 | 9/1989 | Proksa et al. | 198/626.1 |

FOREIGN PATENT DOCUMENTS

| | | | |
|---|---|---|---|
| 1917715 | 10/1970 | Germany | 198/626.1 |

*Primary Examiner*—James R. Bidwell
*Attorney, Agent, or Firm*—Wood, Herron & Evans, L.L.P.

[57] ABSTRACT

A servo drive spring conveyance apparatus is disclosed in which a spring is grasped by a grabbing jaw of a multi-armed conveying star and fed from there to additional stations. The conveyance apparatus includes two belt loops that are provided for the conveyance of the springs.

10 Claims, 2 Drawing Sheets

SPRING CONVEYOR APPARATUS

BACKGROUND OF THE INVENTION

The present invention relates to a spring conveyor apparatus for positioning and feeding a spring from a star shaped conveying hub to a downstream processing station.

Spring conveyor apparatus with servo drive are known wherein a spring is grasped by the gripping hand of a star shaped multi-armed conveyor and fed from there to additional stations. Such machines serve to convey a manufactured spring in a manner suitable for processing and precisely positioned to an arrangement where the springs are mounted on a spring core, a pillow or a seat cushion.

In such spring insertion stations, a spring is grasped by a spring manufacturing machine, which is known per se and thus will not be further described herein, by a gripping hand of a multi-armed conveying star. That spring is then fed to various other downstream stations of the assembly machine via a spring insertion machine.

In commonly assigned published German patent DE 34 26 110, which is hereby incorporated by reference, a spring manufacturing machine was described where a star shaped conveyor was also provided. Each spring produced in that station is inserted into the respective gripping hand of the conveying star, grasped by clamping and fed to a subsequent processing station.

The spring insertion station connected to it functions such that swivelled jaws were provided in the run-out area of the respective gripping hand of the conveying star, which swivelled jaws accepted the spring between them whereby the spring coming from the gripping hand of the conveying star was inserted between these swivelled jaws. Such a swiveling motion of the accepting jaws in the area of the spring insertion station, however, had the disadvantage, that the spring inserted into the spring insertion station could never be positioned precisely enough. This, in connection with the additional disadvantage that the spring had to be precisely aligned via a large number of alignment stations which was associated with high machinery outlays.

Accordingly, in applicant's known prior arrangement, it was not possible for the belt drive to execute different strokes and, consequently, the springs could be conveyed to the transfer arrangement only with the same distance between them. This resulted in the disadvantage that the individual distance between the springs had to be adjusted in the zone of the transfer arrangement located near the end of the drive chain, which resulted in higher machinery outlays and correspondingly increased manufacturing costs for the transfer arrangement.

In the prior art, a mechanical drive connection was used between the conveying star and the downstream spring conveying arrangement which resulted in the disadvantage that only constant strokes could be used and, correspondingly, that only a constant distance between springs could be set.

SUMMARY OF THE INVENTION

It thus is the object of the invention to further develop a spring conveying arrangement as described above such that the entire conveying arrangement is more cost effectively designed, in particular with the goal of making the individual setting of distances between the individual springs adjustable by simple means.

To accomplish this object, two revolving belt loops (8, 9) are provided for the further conveyance of the springs. More particularly, accordingly to one specific aspect of the invention, two synchronously driven belt loops emanating from a central drive are provided, whereby each belt loop forms an upper and a lower strand and that each spring to be transported is inserted clamped between the two opposing strands of the two synchronously arranged belt loops and transported under compression.

Accordingly to another specific aspect, the drive is designed as a servo drive or alternatively as a stepping motor, which for the first time allows the insertion of a spring in the zone of the insertion station such that it results in a constant insertion cycle whereby the belt may be moved at varying speeds in order to thus provide different and individually adjustable distances between the individual springs.

It is another object of this invention to provide the possibility of providing individual distances between the springs by simple means. In accordance with yet another specific aspect of the invention, this may be effected by controlling of the drive to the extent that the stroke, i.e., the feed can be adjusted individually and precisely for each spring gripped. This simplifies to a large degree the transfer arrangement at the end of the spring conveying apparatus.

This transfer arrangement thus no longer needs to subsequently align springs individually but it receives the springs already aligned individually with their corresponding spring distances assigned correctly according to position to the extent that a simple slide bar system can ensure that a group of springs which are already fed to the transfer arrangement in their correct position can be transferred to a downstream assembly machine.

Other objects and specific aspects of the invention will be from the appended description, claims and drawings.

In the following, the invention is described in detail using drawings showing only one embodiment. The drawings and their descriptions disclose further characteristics and advantages essential to the invention.

DETAILED DESCRIPTION OF THE INVENTION

Figure 1:
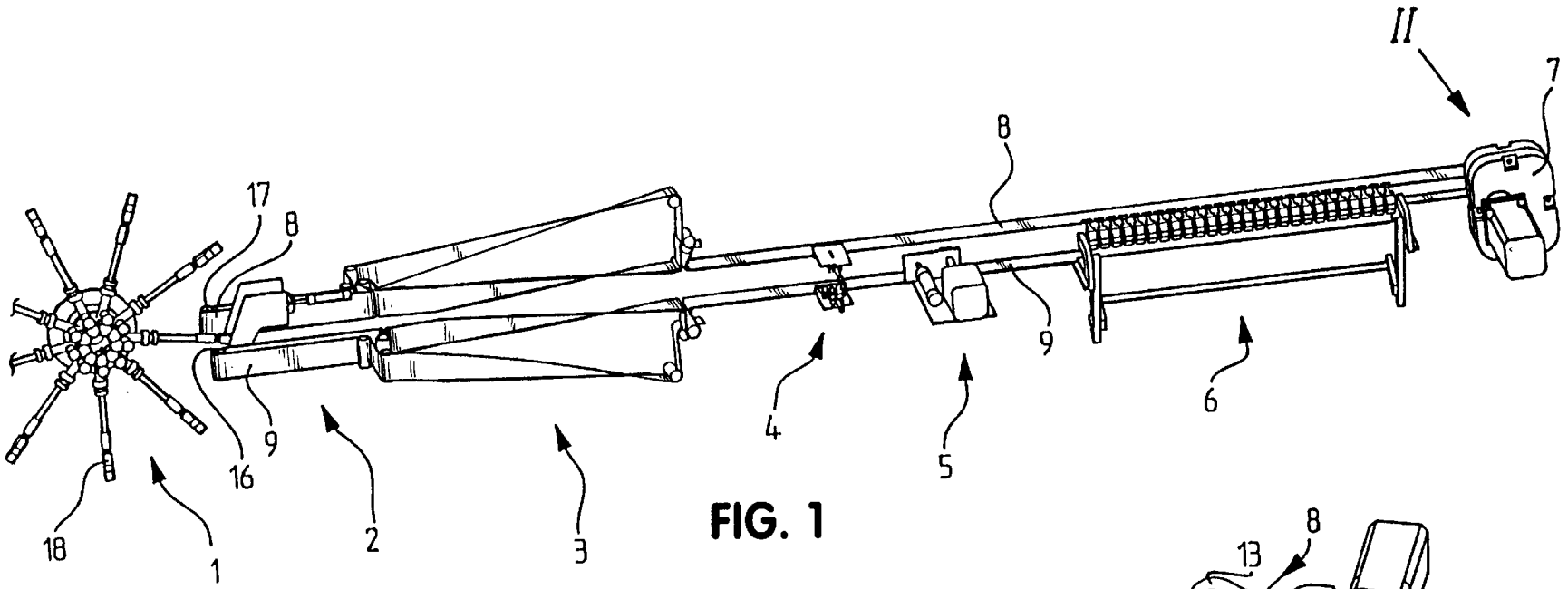
FIG. 1 is a schematic overview of a complete conveyor station starting with a conveying star and ending at a transfer machine.

FIG. 1 shows that a conveying star consists of multi-armed gripping mechanism provided with a group of gripping hands 18 at its corresponding free end whereby a corresponding spring 26 is inserted into each gripping hand 18 where it is held clamped.

The gripping hand feeds the spring 26 into a spring insertion station 2.

Subsequent to insertion and correct alignment of the spring 26 in the spring insertion station, the spring is transferred to a turning station 3, whereby the spring is rotated from a horizontal to a vertical position.

At the run-out of the turning station is disposed a first alignment station 4 which, as a control station, checks only whether the knot of the spring 26 was positioned correctly in the spring insertion station 2.

An additional alignment station 5 ensures that the last spring from the previous group of a group of springs disposed behind each other in the zone of the belt loops 8, 9 is pulled out, turned around and re-inserted in the belt gap of the belt loops 8, 9 as the first spring of the following group.

A transfer arrangement 6, in which the springs are transferred, correctly positioned following one behind another, by means of a transverse shifting system into an assembly machine disposed at right angles to the belt loops 8, 9, is disposed behind the alignment station 5.

Figure 2:
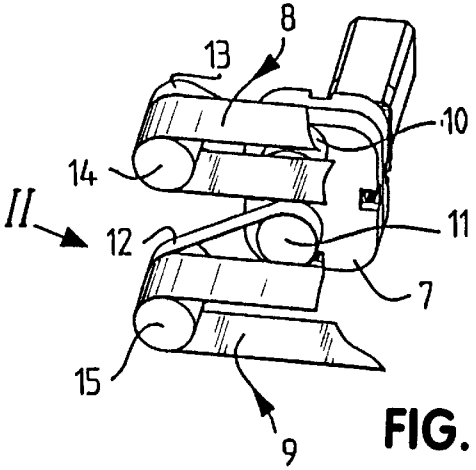
FIG. 2 is schematically, the synchronous belt drive for the two belt loops.

The synchronous drive of the belt loops 8, 9 is effected by a belt drive 7 shown in detail in FIG. 2.

There is a single central drive which drives two synchronous drive shafts 10, 11 via a transmission. Each drive shaft 10, 11 is provided with a toothed belt 12, 13 each of which drives a guide roller 14, 15 free of slip.

The belt loops 8, 9 are each guided by the corresponding guide roller 14, 15.

Each belt loop consists of an upper and a lower strand, and the spring 26 to be inserted is inserted between the two opposing strands of these belt loops 8, 9.

The belt drive 7 is freely programmable, whereby the drive motor may also be designed as a stepping motor and it is thus possible to adjust the distance between the springs in the belt precisely and at will through appropriate variations of the belt drive speed while maintaining the same insertion speed of the conveying star 1.

The two belt loops 8, 9 run over front pulley rollers 16, 17 where they are turned back.

Figure 3:
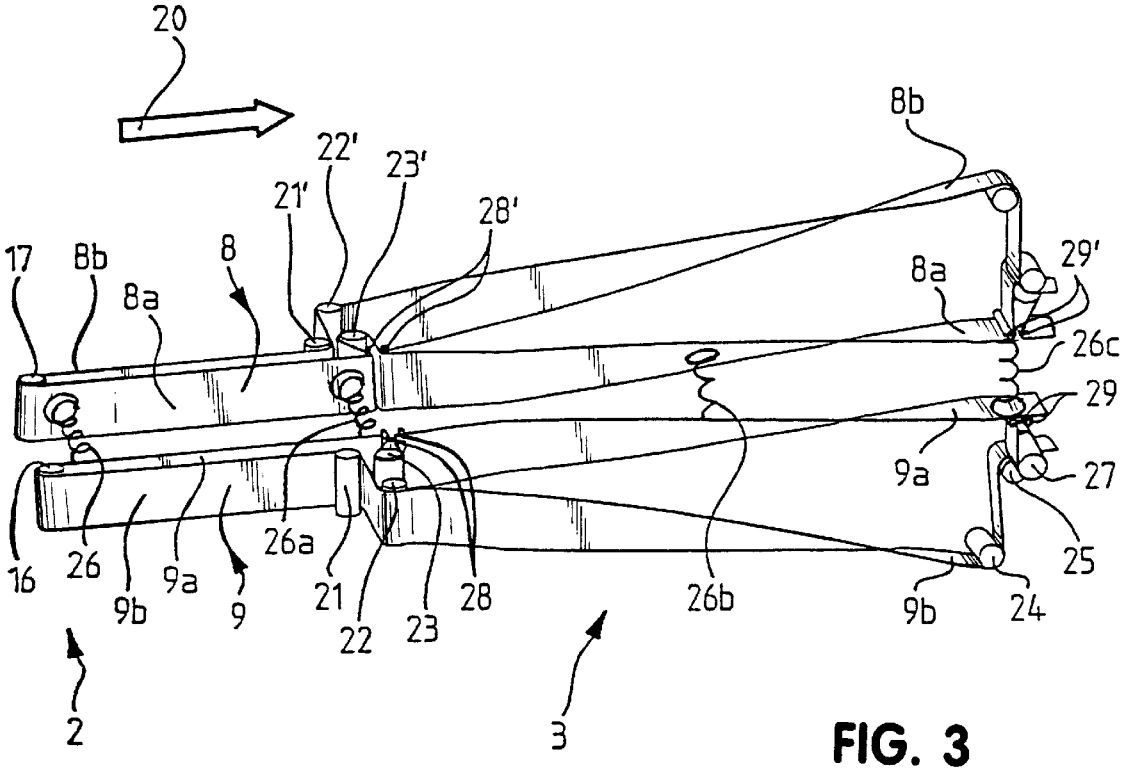
FIG. 3 is a schematic representation of a turning station by which it is possible to turn the springs from a horizontal to a vertical position.

FIG. 3 shows schematically a turn-around station which allows springs 26 inserted horizontally in the spring insertion station to be rotated into a vertical position. This is depicted in FIG. 3 with springs 26, 26*a*, 26*b*, 26*c*.

The turn-around station consists of the two synchronously driven belt loops 8, 9 whereby the belt loop 8 has an inside strand 8*a* and an outside strand 8*b*. Belt loop 9 also has an inside strand 9*a* and an outside strand 9*b*.

The belt guidance of turn-around station 3 is depicted schematically for belt loop 9 whereby belt loop 8, 9 are designed exactly alike and thus position numbers for the identical parts were marked with '.

From the vertical, rotatably mounted guide roller 16 where the front and rear strand 9*a*, 9*b* of the front loop 9 run, the outer strand 9*b* runs over a first guide roller 21 which is in each case also designed with a vertical rotating axle and a second guide roller 22 with a tilted rotating axle.

At a distance from these two guide rollers 21, 22, the guide rollers 24 with a tilted axle and 25 with a horizontal axle are attached such that the outer strand 9*b* of the front belt loop 9 is now guided into a lower strand.

The same is true for strand 9*a* which runs over guide rollers 23, 28 and which is also guided in the zone of guide rollers 27, 29 from a vertical position into a horizontal position.

Springs held clamped and under compression between strand 8*a* and 9*a* are thus turned from the horizontal output position into the vertical output position (spring 26*c*) while maintaining compression in the slit between the two strands 9*a*, 8*a*.

Since the two belt loops 8, 9 are driven precisely synchronously, there is no slip between the two belt loops 8, 9 and the springs are rotated in the turn-around station 3 into a correct position without tipping or changes of their position.

Conveyance subsequently continues in the direction of arrow 20 whereby the previously described alignment station 4 is disposed at the exit of the turn-around station 3.

Since the stroke or the feed of the common drive for the belt loops 8, 9 can be adjusted precisely and is freely programmable, it is possible to convey the springs 26, 26*a*, 26*b*, 26*c* to the installation station with individual distances between them. It is, in particular, possible to convey the springs individually or in groups whereby the distance between the individual springs as well as the individual groups can be specified by a suitable control of the drive 7. Further alignment or subsequent adjustment of distances or distance changes are not required.

We claim:

1. A spring conveying apparatus comprising:

a multi-armed conveying star, a gripping hand at the end of each arm of the conveying star for grasping a spring, spring conveyance means for feeding the spring from the conveying star to a downstream station, wherein the spring conveyance means comprises two belt loops each having an essentially horizontal section, a turning section and an essentially vertical section, and wherein the spring has two opposite ends and remains clamped and under compression between the belt loops with its ends each in contact with a respective one of the [both] belt loops as it is conveyed from the conveying star to the downstream station.

2. The spring conveying apparatus according to claim 1, wherein a common drive is provided for both belt loops.

3. The spring conveying apparatus according to claim 2, wherein the drive is designed as a servo drive.

4. The spring conveying apparatus according to claim 2, wherein the drive is designed as a stepping motor.

5. The spring conveying apparatus according to claim 1 wherein the distance between the opposing strands of the belt loops is smaller than the height of the springs.

6. The spring conveying apparatus according to claim 1 further comprising:

a control station operative to determine the position of a knot of a spring fed to the conveyance means.

7. The spring conveying apparatus according to claim 1, wherein the distance between the belt loops is adjustable with respect to each other.

8. The spring conveying apparatus according to claim 1 further comprising:

an alignment station changing the position of a knot on each spring of a group of springs conveyed by the conveyance means.

9. A method of conveying springs comprising the steps of:

providing a multi-armed conveying star with a gripping hand at the end of each arm of the conveying star for grasping a spring, providing a conveyor for feeding a plurality of springs in spaced relationship from the conveying star to a downstream station with two belt loops each having an essentially horizontal section, a turning section and an essentially vertical section, sequentially grasping a series of springs, each one of the gripping hands, and feeding the springs to spaced apart positions on the conveyor, and conveying the springs from the conveying star to a downstream station with the springs clamped and under compression between the belt loops with opposite ends of each spring each in contact with a respective one of the belt loops, and rotating the springs between an essentially horizontal orientation and an essentially vertical orientation while retaining the springs in the spaced apart relationship on the conveyor and clamped under compression between the belt loops with opposite ends thereof in contact with a respective one of the belt loops.

10. The method according to claim 9 further comprising:

determining the position of a knot of the spring being as the spring fed to the conveyor.

* * * * *